United States Patent [19]

Roberts

[11] 4,128,062

[45] Dec. 5, 1978

[54] CENTER BRACE MEMBER

[75] Inventor: Leslie N. Roberts, Columbus, Ohio

[73] Assignee: Buckeye International, Inc., Columbus, Ohio

[21] Appl. No.: 757,453

[22] Filed: Jan. 6, 1977

Related U.S. Application Data

[63] Continuation of Ser. No. 583,054, Jun. 2, 1975, abandoned.

[51] Int. Cl.[2] ..... B61F 1/02

[52] U.S. Cl. ..... 105/420; 105/199 C; 105/228

[58] Field of Search ..... 105/199 C, 200, 226, 105/228, 230, 416, 420, 421, 419; 213/57; 308/137

[56] References Cited

U.S. PATENT DOCUMENTS

| | | | |
|---|---|---|---|
| 1,097,654 | 5/1914 | Lindstrom | 105/228 |
| 1,766,631 | 6/1930 | Haseltine | 105/200 |
| 1,769,700 | 7/1930 | Lehman | 105/200 |
| 1,775,614 | 9/1930 | O'Connor | 105/200 |
| 2,280,146 | 4/1942 | Duryea | 105/230 |
| 2,399,210 | 4/1946 | Dath | 105/200 |
| 2,680,413 | 6/1954 | Becker | 105/200 |
| 3,040,679 | 6/1962 | Warntz | 105/416 |
| 3,193,111 | 7/1965 | Danielson | 213/8 |
| 3,223,050 | 12/1965 | Warnock | 105/420 |
| 3,561,370 | 2/1971 | Reynolds | 105/420 |

*Primary Examiner*—Albert J. Makay
*Assistant Examiner*—Carl Rowold
*Attorney, Agent, or Firm*—Charles F. Pigott, Jr.

[57] ABSTRACT

An elongated unitary center-sill-and-center-brace member for use with sectionalized railroad car center sills is disclosed herein. The member includes reduced wall portions at each end for telescopic engagement with an inboard center sill section and an outboard center sill section, either of which may be of the double-Z or Wierton-type. In either case, the top surfaces of the sill sections and the top surface of the member lie in the same plane so as to define a flat upper surface for the sill assembly.

2 Claims, 4 Drawing Figures

CENTER BRACE MEMBER

This is a continuation of application Ser. No. 583,054, filed June 2, 1975, now abandoned.

BACKGROUND OF THE INVENTION

This invention relates to a center sill of the type used in a standard open-top railway hopper car, and more particularly to the portion of the sill to which a center brace is applied.

In a standard open-top hopper railway car, the center sill extends the full length of the car and a separate cast center brace or bolster center filler is applied or inserted into the sill. The as-cast brace is usually not within the accepted dimensional tolerances and is brought within those tolerances by (1) hot die pressing or (2) machining prior to insertion of the brace in the sill. After insertion the brace is welded to the sill.

It is desirable to avoid both the hot pressing operations and the machining operations, and it is therefore an object of this invention to provide a center sill and center brace assembly which obviates the need for hot pressing or its equivalent machining.

Heretofore casting and handling problems have occurred in connection with the manufacture of center sills and with draft arms, which are a section of the sill including the brace and coupler.

It is another object of this invention to avoid the casting and handling problems associated with center sills and draft arms.

Center sills are either of the well-known double-Z or Wierton-type, and it is thus yet another object to provide a center brace member which can be used with either type of sill.

It is still another object of this invention to provide a center-sill-and-center-brace member of relatively simple design and construction, that is relatively inexpensive to manufacture, easy to install, dependable in operation, and capable of performing properly after long periods of use.

The foregoing and other objects and advantages will be apparent from the following description and appended claims, taken in conjunction with the accompanying drawings.

SUMMARY OF THE INVENTION

There is provided by virtue of this invention a unitary center-sill-and-center-brace member for use in a railway car. This member avoids the tolerance problems associated with a cast center brace, and is relatively short so as to avoid casting and handling problems. Furthermore, the member can be used interchangeably with either the double-Z or Wierton-type sill sections.

When assembled the member is positioned between and in longitudinal alignment with inboard and outboard sections of the center sill. The member includes: (1) means at each end which engage the respective sill sections and assure proper alignment and positioning, and (2) a top web surface which is constructed to lie substantially in the same horizontal plane as the top webs of the sill sections so as to define a relatively flat top surface for the sill assembly.

A more detailed explanation of the invention is provided in the following description and claims and is illustrated in the accompanying drawings.

DESCRIPTION OF THE ILLUSTRATIVE EMBODIMENT

Figure 1:
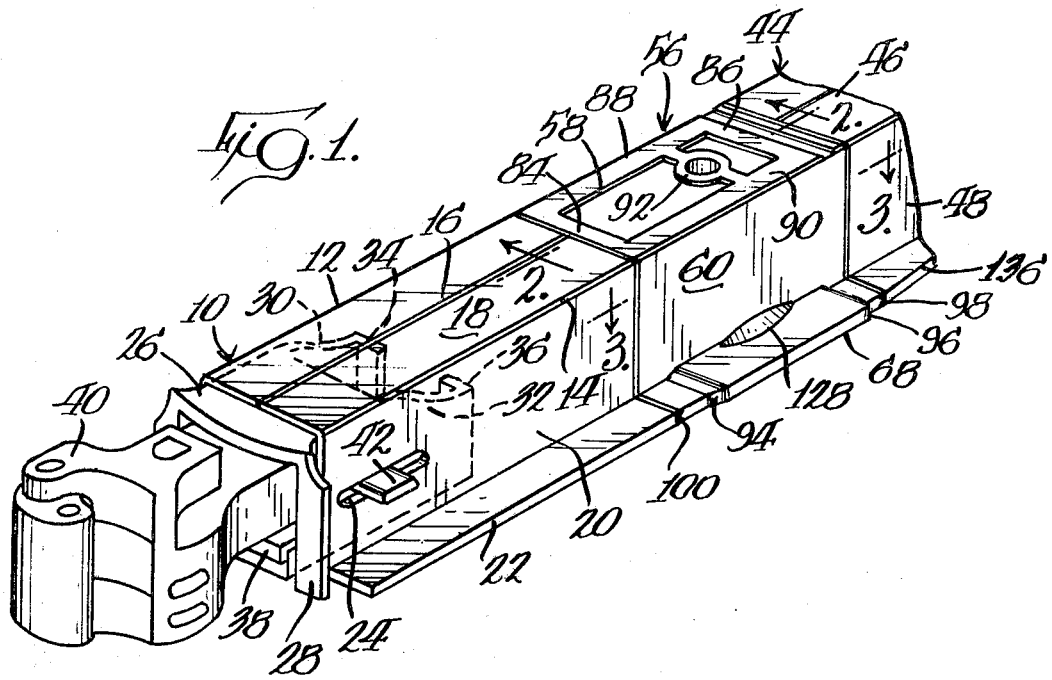
FIG. 1 is a perspective view of a portion of a center sill for a railway car showing a unitary center brace and sill member positioned between and secured to the outboard sill and the inboard sill sections.
Figure 2:
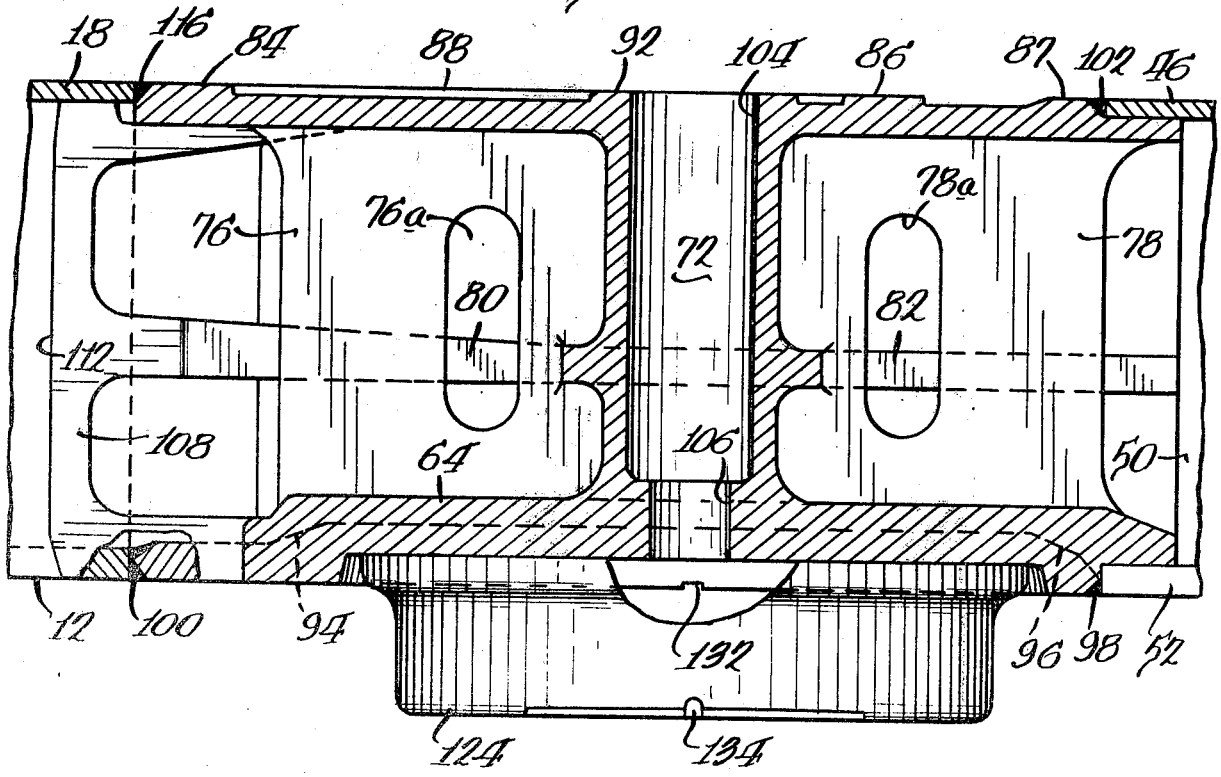
FIG. 2 is an enlarged cross-sectional view of the center brace and sill member taken substantially along line 2—2 of FIG. 1 and also showing a body center plate mounted to the underside of the member.

Referring now to the drawings, there is shown an outboard center sill section 10 of the conventional double-Z type which is formed from a pair of rolled-steel Z sections 12 and 14 that have been welded together at the joint 16. The sill is an open-bottom, channel-shaped member including a top web 18 and a pair of side walls, such as 20, each of which are connected along one edge to the top web. Each of the side walls terminates, along an opposite edge, in a lower outwardly-extending flange, such as 22. At the outboard end of the section, a pair of aligned draft key slots, such as 24, are provided, one in each of the side walls.

A striker assembly 26 is fitted and welded to the outboard sill section at its outboard end and includes (1) a striker face 28, which extends forwardly of the outboard end of the sill, and (2) a pair of integral front draft lugs 30 and 32 positioned within the sill and which terminate in inner faces 34 and 36, respectively. Draft key apertures are provided in the side walls of the striker assembly intermediate the striker face 28 and inner faces 34 and 36. The striker draft key apertures are aligned with the draft key slots in the sill. A coupler wear plate 38 is mounted to the striker at its outboard end below the upper edge of the striker face.

A coupler assembly 40 and its associated yoke (not shown) are mounted to the outboard end of the sill and are secured to the sill by a draft key 42, which extends through the sill draft key slots, the striker draft key apertures and coupler and yoke.

A Wierton-type inboard center sill section 44 is positioned inwardly of the outboard section 10. Although a Wierton-type sill is shown, it is understood that a double-Z type may also be used. The inboard sill is a somewhat boxlike member and includes a top web 46, a pair of side walls 48 and 50 which extend downwardly from the top web, and a pair of lower inwardly-extending flanges 52 and 54, one along the lower edge of each side wall.

A combined center brace and sill member 56 is provided for positioning in longitudinal alignment between the inboard and outboard sill sections. The member is a unitary casting, preferably of steel.

The center member is an elongated boxlike structure having a top web surface 58, a pair of side walls 60 and 62 extending downwardly therefrom, and a bottom plate 64 which connects to the bottom edges of the side walls and extends laterally outwardly therefrom to define a pair of outwardly-extending flanges 66 and 68.

A centrally positioned internal king post 70 defines a vertical kingpin hole 72, and extends between and is connected to the top web 58 and bottom plate 64. A pair of internal, laterally-extending, vertically-oriented webs 73 and 74 are also provided, and each member of the pair interconnects one side of the post, the top web, the bottom plate and one of the side walls. In a similar manner, a pair of internal, longitudinally-extending, vertically-oriented webs 76 and 78 interconnect the post, the top web and bottom plate. Each of the longitudinal webs 76 and 78 include an aperture 76*a* and 78*a* to reduce the weight of the member and to facilitate ease of casting and manufacture. A pair of internal, bifurcated longitudinally-extending, horizontally-oriented webs 80 and 82 are positioned between and in generally parallel relation to the top web and bottom plate. The bifurcated webs interconnect the side walls, the vertical webs and the post.

The top web 58 is constructed and arranged to lie in the same plane as the top web 18 of the outboard center sill portion 10 and the top web 46 of the inboard center sill portion 44. Furthermore, the top web of center brace portion is recessed so as to form an outboard pad 84, inboard pads 86 and 87, a left and a right longitudinal pad 88 and 90, and a center pad 92. The use of such recesses and pads reduces the amount of machining required to finish the top surface.

The bottom plate 64 includes a relatively thick raised central section which extends into and strengthens flanges 66 and 68. At each end of the thick central flange section, tapered portions, such as 94 and 96, join the central flange section to the inboard and outboard beveled flange sections 98 and 100. A body plate socket 102 or recess is provided in the underside of the thick section of the bottom plate 64.

The kingpin hole 72 includes a upper cylindrical section 104 which extends through the center pad 92 in the top web and which is of greater diameter than the lower cylindrical section 106. The lower section 106 of the kingpin hole extends through the bottom plate and opens into the socket.

Figure 3:
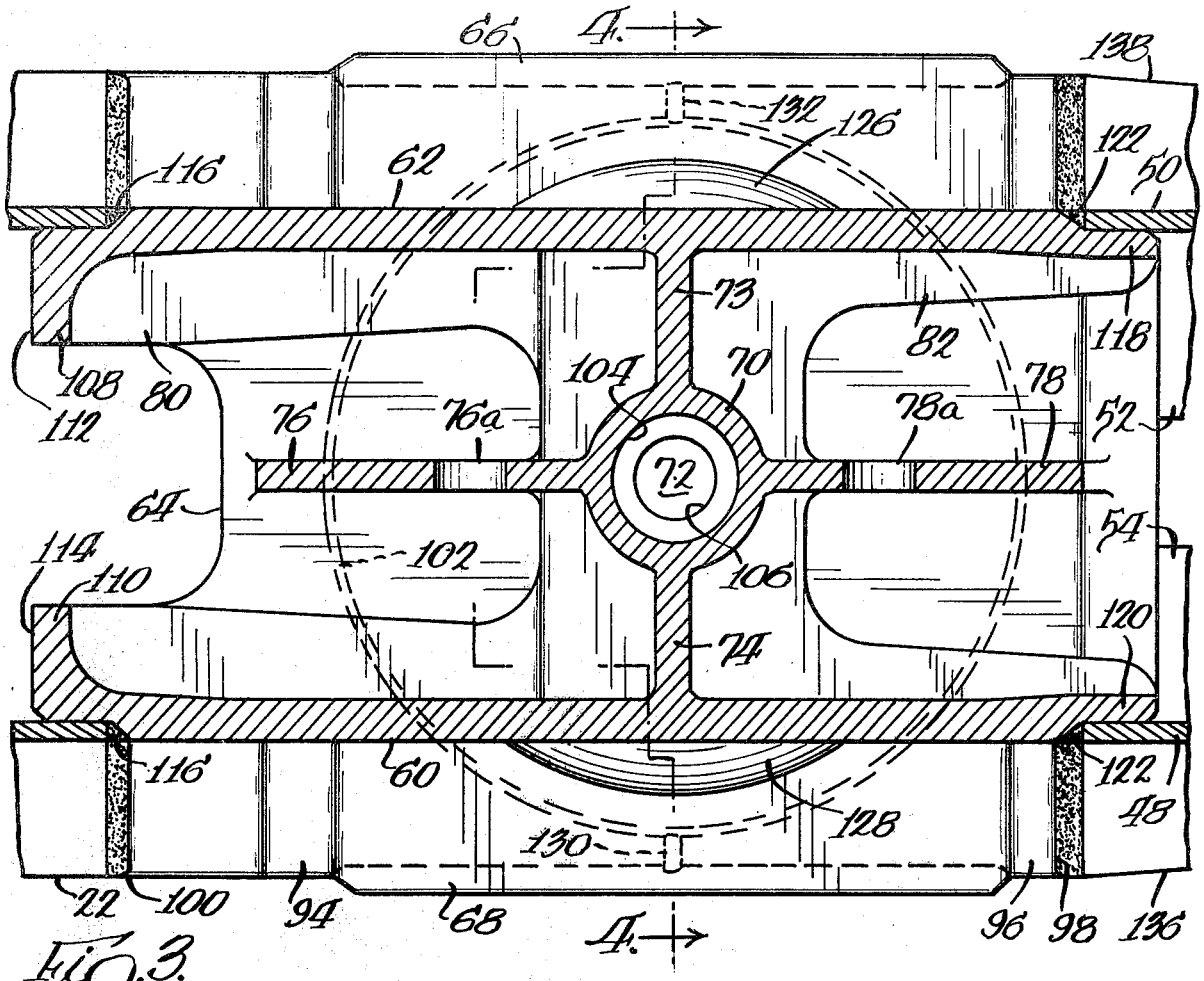
FIG. 3 is an enlarged cross-sectional view of the member taken substantially along line 3—3 of FIG. 1.
Figure 4:
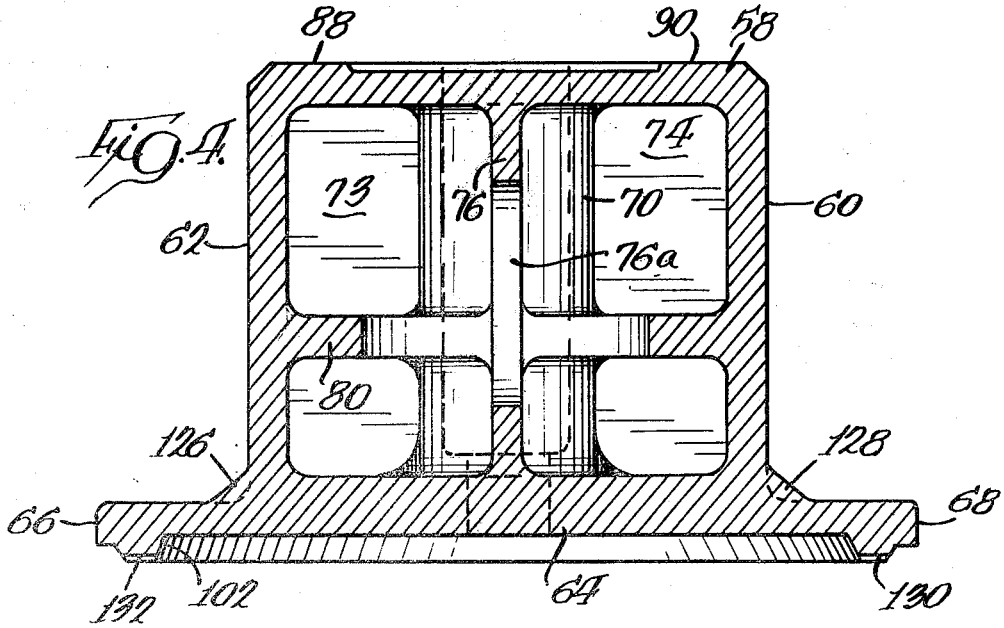
FIG. 4 is a cross-sectional view of the member taken substantially along line 4—4 of FIG. 3 with the top half of the member included.

The rear draft lugs 108 and 110 are cast integral with the center brace member and extend in the outboard direction away from the center of the railway car. Each lug is formed by the side wall 60 or 62, the top web 58, and the bottom plate 64 and terminates in an outboard face 112 or 114. The lugs are strengthened and reinforced by the horizontal web 80. The rear draft lugs are slightly narrower and shorter than the member so as to permit them to telescopically fit within and engage the inner surfaces of the outboard sill section. By virtue of the lugs being narrower and shorter, a shoulder 116 is defined about the top and sides of the member. When the rear draft lugs are fitted within the outboard sill section, the lugs longitudinally align the outboard sill section and member and the inboard edges of the outboard sill section abut the shoulder 116 so as to position the outboard sill section and member. As best shown in FIG. 3, the ends of each rear draft lug is chamfered as are the shoulders to provide welding grooves for welding the center brace member 56 to the outboard center sill portion 10.

The inboard extensions 118 and 120 are also integral with the member and extend in the inboard direction toward the center of the railway car. These extensions are formed of a side wall and the top and bottom webs and are strengthened by the web 82. The top and bottom webs extend across and connect the extensions so as to define a boxlike portion that is slightly narrower and shorter than the member itself and which telescopically fits within and engages the inboard center sill section. This reduced size defines a boxlike shoulder 122. These extensions function in a same manner as the draft lugs, to longitudinally align and position the member and the inboard sill section. However, the lower edge of each of the inboard extensions engages one of the lower flanges 52 or 54 of the inboard sill section which is not the situation with the rear draft lugs.

The socket 102 in the bottom plate is coaxially aligned with the kingpin hole 72 for receiving a separate body center plate 124. The socket is strengthened by curved reinforcement sections 126 and 128 formed of cast metal built up along lower outwardly-extending flanges 66 and 68 and joining the flanges to the side walls. In the flanges, adjacent socket 102 and laterally aligned therewith are a pair of alignment notches 130 and 132. The notches are to be aligned with similar alignment notches, such as 134, in the body center plate when the body center plate is welded to the bottom plate. While a separate body center plate is shown, it is understood that the center plate may be cast integral with the member.

A pair of tapered reinforcement plates 136 and 138 are welded to the side walls 48 and 50 of the Wierton-type inboard center sill section to smoothly join the center member to the inboard sill section. Tapered reinforcement plates are not necessary when a conventional double-Z type inboard center sill section is used since such outwardly-extending flanges are already present.

In a hopper railway car, the center line of kingpin hole is 17-$\frac{1}{8}$ inches from the outboard faces 112 and 114 of the rear draft lugs 108 and 110 and 4 feet 11-$\frac{1}{2}$ inches from the striker face 28. The inside width of both the outboard and inboard center sill portions 10 and 44 are 12-$\frac{7}{8}$ inches for snugly receiving the outboard end of rear draft lugs 108 and 110 and the inboard end of the inboard extensions 118 and 120.

While center member 56 has particular application in a standard open-top hopper car, such as a coal-carrying car, those skilled in the art will appreciate that the center member may also be applied to other types of railway cars.

Although an embodiment of the invention has been shown and described, it is to be understood that various modifications and substitutions may be made by those skilled in the art without departing from the novel spirit and scope of the invention.

What is claimed and desired to be secured by Letters Patent of the United States is:

1. A unitary cast center sill portion to be welded between outboard and inboard center sill sections in longitudinal alignment therewith to form an elongated center sill for a railway car, at least one of said center sill sections being of the double-Z type having opposed horizontal side flanges at the lower end thereof, said unitary cast center sill portion comprising, in combination, a horizontal top wall, a pair of vertical side walls depending from said top wall, side flanges extending horizontally outwardly from the lower end of said side walls along the entire length of said center sill portion, a pair of rear draft lugs formed at the outboard end of said center sill portion, said outboard end, including said rear draft lugs, and the inboard end of said center sill portion, being of reduced dimensions so as to telescrope respectively into the adjacent ends of said outboard and inboard center sill sections with the top wall, side walls and horizontal flanges of said center sill portion in substantially coplanar relation with corresponding walls and flanges of at least one of said center sill sections, a king post cast integral with said center sill portion extending from the bottom wall to the top wall thereof so as to be reinforced by both said walls, said king post having a vertical hole formed therein which is of a reduced diameter adjacent the lower end of said king post and is of increased diameter for the remainder of the length of the post, and a recessed area formed in said top wall of said center sill portion intermediate the boundaries thereof for reducing the area required to be machined to render said top wall substantially coplanar with the top walls of said outboard and inboard center sill sections.

2. A unitary cast center sill portion as defined in claim 1 where the bottom wall of said center sill portion is substantially thicker than the flanges which extend horizontally outwardly therefrom, and each of said flanges is tapered down to a reduced thickness at both the inboard and outboard ends thereof, the reduced ends of said flanges being of approximately the same thickness as corresponding flanges on said outboard and inboard center sill sections.

* * * * *